US005228416A

United States Patent [19]

Puzio

[11] Patent Number: 5,228,416

[45] Date of Patent: Jul. 20, 1993

[54] INTERNAL COMBUSTION ENGINE HAVING OPPOSED PISTONS

[76] Inventor: Eugene T. Puzio, 199 Park Ave., Trenton, N.J. 08690

[21] Appl. No.: 705,410

[22] Filed: May 24, 1991

[51] Int. Cl.[5] ..... F02B 75/22

[52] U.S. Cl. ..... 123/56 R; 123/197.1

[58] Field of Search ..... 123/55 R, 56 R, 56 AB, 123/56 B, 56 BB, 197.1, DIG. 1, DIG. 2, DIG. 8

[56] References Cited

U.S. PATENT DOCUMENTS

| | | | |
|---|---|---|---|
| 2,844,040 | 7/1958 | Bancroft | 123/55 R |
| 3,175,544 | 3/1965 | Hughes . | |
| 3,181,515 | 5/1965 | Zurich . | |
| 3,258,992 | 7/1966 | Hittell . | |
| 3,274,982 | 9/1966 | Noguchi et al. . | |
| 3,277,743 | 10/1966 | Kell . | |
| 3,311,095 | 3/1967 | Hittell . | |
| 3,328,976 | 7/1967 | Shoemaker et al. | 123/DIG. 8 |
| 3,329,134 | 7/1967 | Llewellyn | 123/55 R |
| 3,894,522 | 7/1975 | Bennett | 123/56 AB |
| 3,977,303 | 8/1976 | Baker | 91/493 |
| 4,077,267 | 3/1978 | Schottler | 123/55 A |
| 4,331,108 | 5/1982 | Collins | 123/50 R |
| 4,641,611 | 2/1987 | Stiller et al. | 123/55 A |
| 4,682,569 | 7/1987 | Stiller et al. | 123/55 A |
| 4,850,313 | 7/1989 | Gibbons | 123/55 R |

*Primary Examiner*—David A. Okonsky
*Attorney, Agent, or Firm*—Sperry, Zoda & Kane

[57] ABSTRACT

An internal combustion engine utilizing a disk-shaped crankshaft operatively connected with respect to at least one pair of opposed pistons. Each piston of each pair is fixedly secured with respect to a shaft extending therebetween. With two pairs of pistons they are arranged at right angles with respect to one another such that each piston fires controlled by a timing device to maintain the rotary crankshaft. The crankshaft can include a gear device or a friction surface device about the external periphery thereof to facilitate distribution of power therefrom. The crankshaft defines an aperture therein within which a crank pin is positioned with an offset connecting arm extending in each opposite direction. The offset connecting arm extends into a bore within which is positioned the rod extending to each pair of pistons. The path of movement of the crank pin is circular to receive driving force from the pistons at selectively timed intervals.

16 Claims, 5 Drawing Sheets

INTERNAL COMBUSTION ENGINE HAVING OPPOSED PISTONS

BACKGROUND OF THE INVENTION

1. Field Of The Invention

The present invention deals with the field of devices for providing power and more specifically to the field of devices for providing power through internal combustion engines. Such engines conventionally include a rotary crankshaft, a rotational to reciprocal connecting rod or arm as well as a plurality of pistons powered through combustion chambers by various powering means such as combustion of petroleum.

This invention more particularly pertains to internal combustion engines of a rotary nature utilizing pistons arranged in various angles with respect to one another to control even an efficient operation of the engine.

2. Description Of The Prior Art

Prior art devices have been designed for internal combustion engines of various configurations such as shown in U.S. Pat. No. 3,175,544 issued Mar. 30, 1965 to J. W. Hughes on Internal Combustion Engines; U.S. Pat. No. 3,181,515 issued May 4, 1965 to N. O. Zurich on an Internal Combustion Engine; U.S. Pat. No. 3,258,992 issued Jul. 5, 1966 to J. L. Hittell on Reciprocating Piston Engines; U.S. Pat. No. 3,274,982 issued Sep. 27, 1966 to M. Noguchi et al on a Two-Cycle Two-Cylinder Internal Combustion Engine; U.S. Pat. No. 3,277,743 issued Oct. 11, 1966 to N. B. Kell on a Crankshaft With Floating Crank Throws; U.S. Pat. No. 3,311,095 issued Mar. 28, 1967 to J. L. Hittell on Reciprocating Piston Engines; U.S. Pat. No. 3,977,303 issued Aug. 31, 1976 to A. Baker on Engines And Compressors; U.S. Pat. No. 4,077,267 issued Mar. 7, 1978 to H. Schottler on a Fluid Transducer; U.S. Pat. No. 4,331,108 issued May 25, 1982 to B. Collins on a Radial Engine; U.S. Pat. No. 4,641,611 issued Feb. 10, 1987 to A. Stiller et al on an Oscillatory Motion Apparatus; U.S. Pat. No. 4,682,569 issued Jul. 28, 1987 to A. Stiller et al on an Oscillatory Motion Apparatus; and U.S. Pat. No. 4,850,313 issued Jul. 25, 1989 to P. Gibbons on a Cruciform Engine.

SUMMARY OF THE INVENTION

The present invention includes an internal combustion engine having opposed pairs of pistons which includes an inner crankcase defining an inner chamber therein. The inner crankcase further includes a first connecting arm aperture and a second connecting arm aperture defined therein.

A crankshaft is included which is generally disk-shaped. The crankshaft is mounted within the inner chamber of the inner crankcase preferably within a crankshaft bearing means. The crankshaft preferably defines a crank pin aperture extending axially therethrough at a position radially outwardly from the axis of the crankshaft itself in such a manner as to be rotatable about the crankshaft axis responsive to rotation of the crankshaft itself. The crankshaft further defines a driving means preferably positioned thereabout to facilitate distribution of driving power therefrom. This driving means can take the form of a plurality of gearing teeth or can comprise a friction surface.

A first outer crankcase is preferably fixedly secured with respect to the inner crankcase in such a manner as to define a first outer chamber therein which is designed to be in fluid flow communication with respect to the inner chamber means through the first connecting arm aperture. The first outer crankcase further defines a first piston bore extending longitudinally therethrough. In a similar manner a second outer crankcase defines a second outer chamber in fluid flow communication with respect to the inner chamber through the second connecting arm aperture. The second outer crankcase defines also a second piston bore extending longitudinally therethrough.

A crank pin is adapted to be positioned extending through the crank pin aperture in the crankshaft. The crank pin means is rotatable with respect to the crank pin aperture. A first connecting arm is defined fixedly secured with respect to the crank pin and extends outwardly through the first connecting arm aperture means into the first outer crankcase. In a similar manner a second connecting arm is designed to be fixedly secured with respect to the crank pin to extend outwardly through the second connecting arm aperture into the second outer crankcase. Each of the first and second connecting arms are preferably offset laterally.

A first piston assembly is positioned within the first piston bore means such as to be reciprocally movable therethrough axially. The first piston assembly preferably includes a first piston rod extending longitudinally through the first piston bore to define a first connecting bore therein. The first connecting arm is adapted to extend through the first connecting arm aperture into the first connecting bore means to urge movement of the first piston rod therewith. The first piston rod also defines a first rod end and a second rod end into which is secured a first piston and a second piston, respectively.

In a similar manner a second piston assembly is positioned extending through the second piston bore to be reciprocally axially movable therewith. The second piston assembly further includes a second piston rod extending longitudinally through the second piston bore to define a second connecting bore therein. The second connecting arm is adapted to extend through the second connecting arm aperture into the second connecting bore to urge movement of the second piston rod means therewith. Furthermore the second piston rod includes a third rod end and a fourth rod end to which are secured a third piston and a fourth piston, respectively.

With the offset of the first and second connecting arm means the axis of the first connecting bore and the second connecting bore will be laterally spatially disposed with respect to the axis of the crank pin aperture defined by the crankshaft. This is necessary in order to achieve continuous and complete efficient operation of the engine of the present invention.

It is an object of the present invention to provide a rotary internal combustion engine having opposed sets of pistons wherein initial capital outlay is minimized.

It is an object of the present invention to provide a rotary internal combustion engine having opposed sets of pistons wherein costs are minimized.

It is an object of the present invention to provide a rotary internal combustion engine having opposed sets of pistons wherein maintenance expenses are minimized.

It is an object of the present invention to provide a rotary internal combustion engine having opposed sets of pistons wherein maintenance down time is minimized.

It is an object of the present invention to provide a rotary internal combustion engine having opposed sets of pistons wherein reliability is significantly enhanced.

It is an object of the present invention to provide a rotary internal combustion engine having opposed sets of pistons wherein drive can be distributed from gear teeth positioned on the external surface of a circular disk-shaped driveshaft.

It is an object of the present invention to provide a rotary internal combustion engine having opposed sets of pistons wherein drive can be distributed from a friction surface positioned on the external surface of a circular disk-shaped driveshaft.

It is an object of the present invention to provide a rotary internal combustion engine having opposed sets of pistons wherein a minimum number of moving parts are provided.

It is an object of the present invention to provide a rotary internal combustion engine having opposed sets of pistons wherein power is available to drive the crankshaft at any rotational orientation.

It is an object of the present invention to provide a rotary internal combustion engine having opposed sets of pistons wherein bearing surfaces are provided to facilitate lubricated rotation of moving parts with respect to one another.

It is an object of the present invention to provide a rotary internal combustion engine having opposed sets of pistons wherein careful and accurate control of power output is achievable.

It is an object of the present invention to provide a rotary internal combustion engine having opposed sets of pistons wherein a laterally short crankshaft can provide power on the external peripherally located rotating surface thereof.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
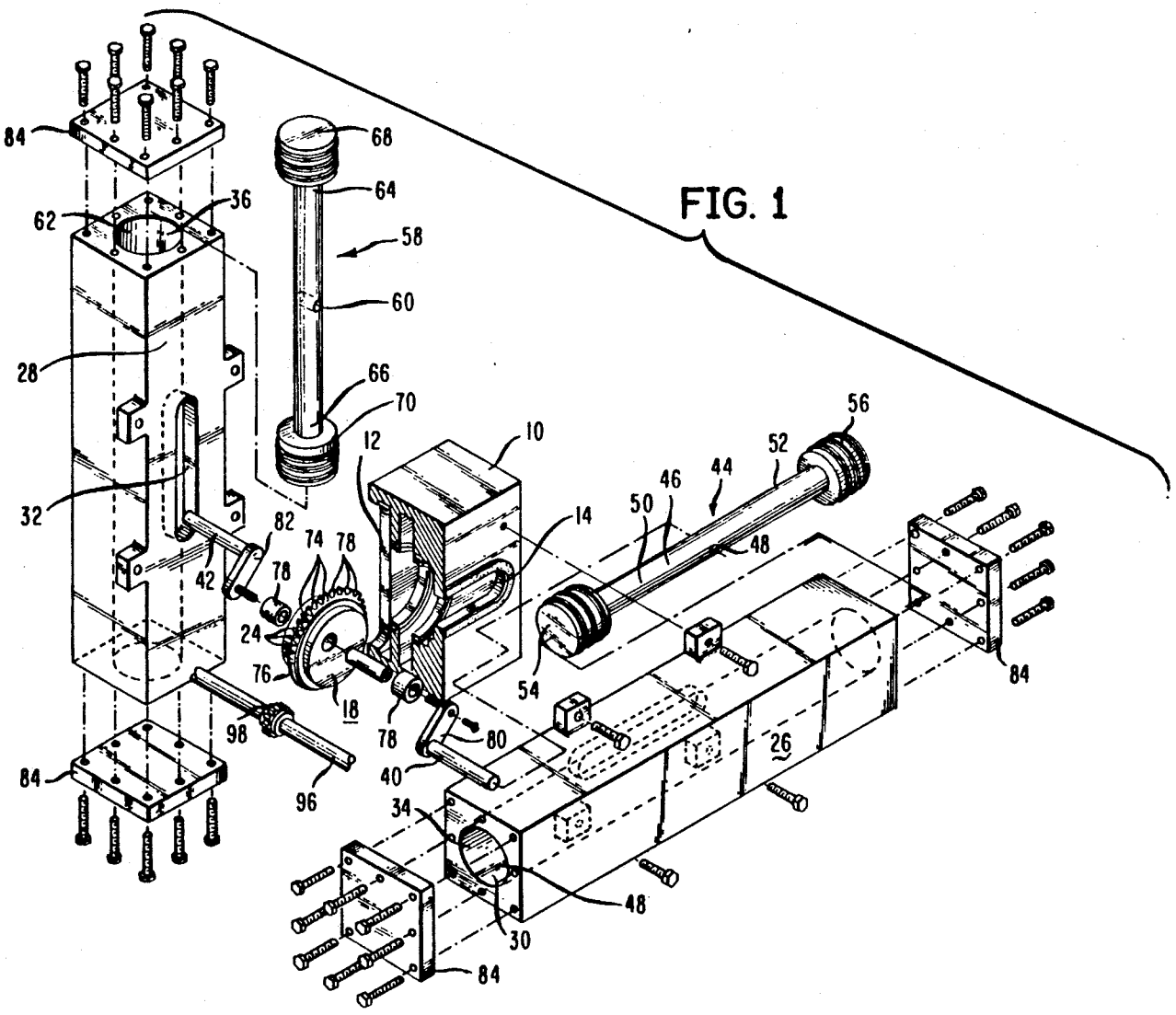
FIG. 1 is an exploded perspective illustration of an embodiment of the internal combustion engine of the present invention.

The rotary internal combustion engine of the present invention includes an inner crankcase means 10 designed to house the crankshaft means 18 within the inner chamber means 12 defined therein. Preferably the inner chamber means 12 will be designed to include lubrication means for lubricating of the moving parts. The crankshaft means 18 preferably will be positioned rotatably within a crankshaft bearing means 86 which is fixedly mounted in the inner crankcase 10. Crankcase bearing means 86 will facilitate rotation of the crankshaft means 18 with respect to the inner crankcase 10 and the inner chamber 12. Crankshaft means 18 will be rotatable about a crankshaft axis means 20 defined thereby.

Figure 2:
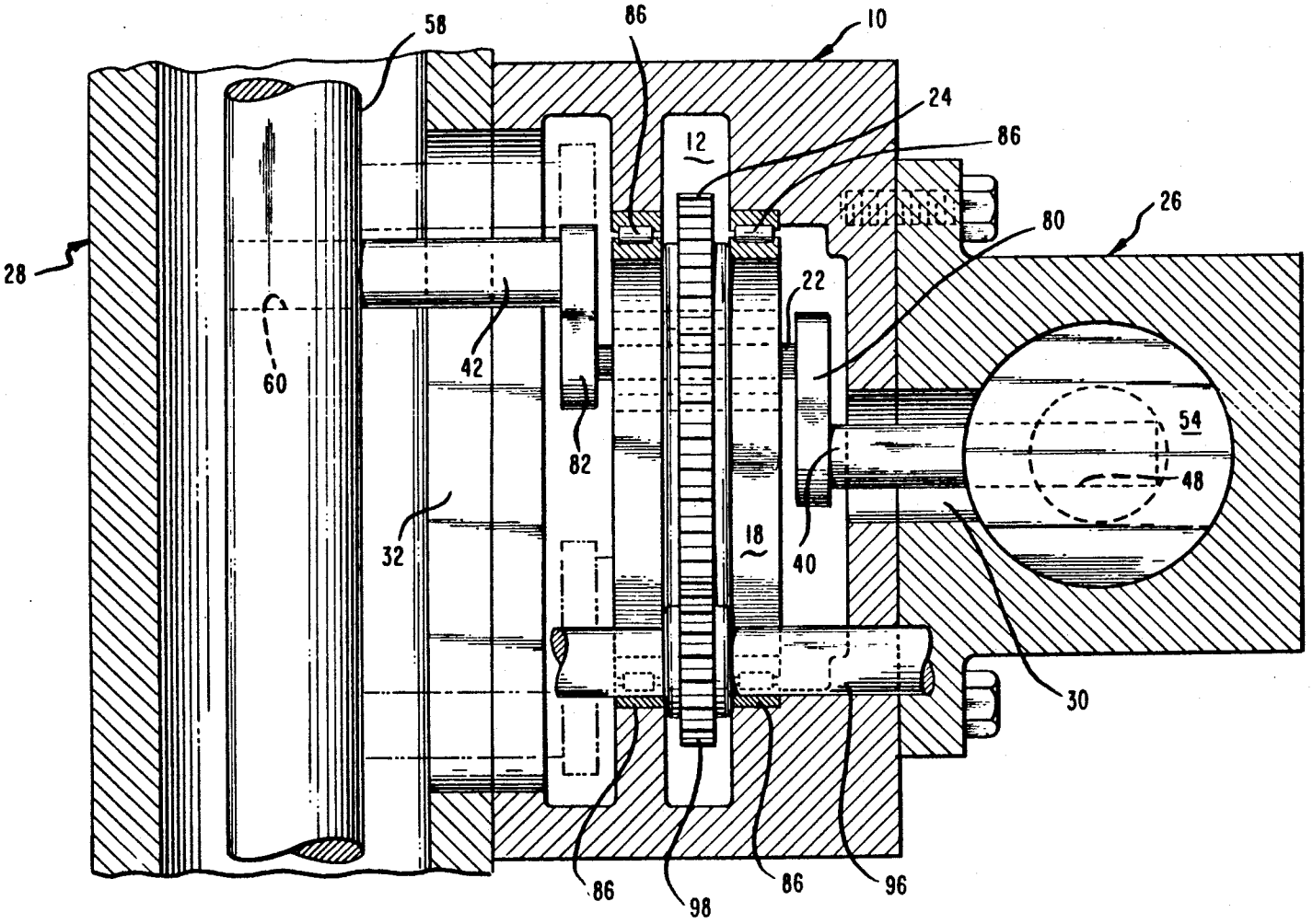
FIG. 2 is a cross-sectional view of an embodiment of the inner crankcase configuration of the internal combustion engine of the present invention.

Crankshaft means 18 will preferably define a crank pin aperture means 22 extending laterally therethrough. The crankshaft 18 preferably be of a short disk-shaped configuration as shown in FIGS. 1 and 2. With this configuration the crank pin aperture means 22 will be spatially disposed radially from the crankshaft axis 20. As the crankshaft 18 is rotated the crank pin aperture 22 will rotate about the crankshaft axis 20. The driven crankshaft 18 will be capable of distributing power through a driving means 24 preferably positioned about the external periphery thereof. Preferably such driving means 24 will be positioned about the external circumference of the disk-shaped crankshaft such as through a gear drive means 74 as shown in FIG. 1 or through a friction surface drive means 76 as also shown in the lower portion of the crankshaft 18 shown in FIG. 1. With either configuration power can be drawn off the crankshaft responsive to movement of the external periphery of the disk-shaped crankshaft 18. With the use of a gear drive means 74, power can be made available by engagement with a countershaft gear means 98 positioned upon a countershaft 96 mounted rotatably within said inner crankcase means 10.

The crank pin aperture means 22 is designed to receive a crank pin means 38 extending therethrough. Crank pin means 38 is preferably rotatably movable with respect to crank shaft 18. This rotational movability is facilitated by the positioning of a crank pin aperture bearing means 78 within the crank pin aperture means 22 between the crankshaft 18 and the crank pin means 38.

Preferably the crank pin means 38 includes a bore at each opposite outwardly facing end thereof which is preferably splined or slotted. The crank pin means 38 is adapted to receive extending therein the first connecting arm means 40 at one end thereof and the second connecting arm means 42 at the opposite end thereof. The first connecting arm means 40 preferably includes a first offset arm 80 therein and a second connecting arm means 42 preferably includes a second offset arm 82 included therein.

Figure 5:
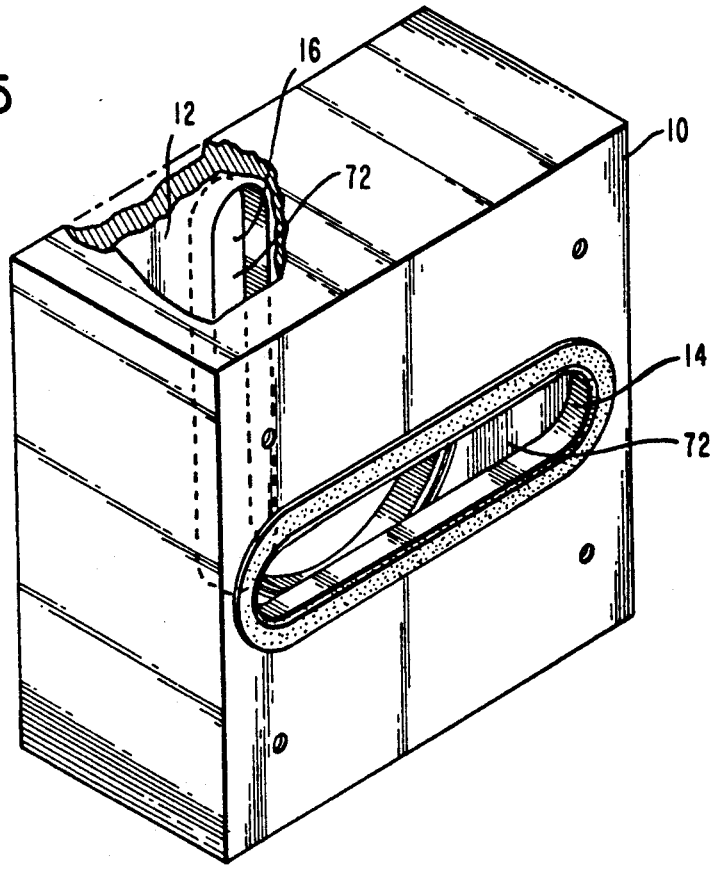
FIG. 5 is a perspective illustration of an embodiment of the inner crankcase element of the present invention.

The inner crankcase 10 preferably defines a first connecting arm aperture means 14 and a second connecting arm aperture means 16 defined in the outer periphery thereof. The first connecting arm means 40 is adapted to extend outwardly through the first connecting arm aperture means 14 and in a similar fashion these second connecting arm means 42 is adapted to extend outward through the oppositely positioned second connecting arm aperture means 16. Preferably aperture means 14 and 16 will both have a slotted configuration 72 as shown best in FIG. 5. This slotted or oval configuration will facilitate the natural movement of the first connecting arm 40 and the second connecting arm 42 responsive to rotational movement of the crankshaft 18.

A first outer crankcase means 26 is preferably securable with respect to the inner crankcase means 10 to be fixed thereto. The first outer crankcase means 26 defines a first outer chamber means 30 therein which is adapted to be in fluid flow communication with the inner crankcase means 10 through the first connecting arm aperture means 14. In a similar fashion a second outer crankcase means 28 is included fixedly secured with respect to the inner crankcase means 10. The second outer crankcase means 28 defines a second outer chamber means 32 therein which is in fluid flow communication with respect to the inner crankcase means 10 through the second connecting arm aperture means 16. With this configuration full flow of lubrication through the moving parts of the engine of the present invention can be greatly facilitated.

The first outer crankcase means 26 preferably defines a first piston bore means 34 extending longitudinally therethrough. In a similar manner the second outer crankcase means 28 preferably includes a second piston bore means 36 extending longitudinally therethrough. Each of the piston bore means 34 and 36 are designed to receive a piston assembly means extending therethrough to facilitate powering of drive of the crankshaft 18 through powering of movement of the first connecting arm means 40 and the second connecting arm means 42.

The first piston assembly means 44 is designed to be positioned extending through the first piston bore means 34. First piston assembly means 44 includes a first piston rod means 46 defining a first rod end 50 and a second rod end 52 thereon oppositely positioned with respect to one another. A first piston means 54 is attached with respect to the first end means 50 and a second piston means 56 is secured with respect to the second rod end means 52. In this manner the first piston means 54 and the second piston means 56 are operatively connected with respect to one another. Linking of movement between the crankshaft 18 and the pistons 54 and 56 is made possible by a first connecting bore means 48 being defined within the first piston rod means 46. First connecting bore means 48 is designed to receive the offset end of the first connecting arm means 40 positioned therein. As such powered reciprocating movement of the first piston rod means 46 within the first piston bore means 34 will cause reciprocating movement of the first connecting arm means 40 along the slotted first connecting arm aperture means 14. This will provide power to the crankshaft 18 at various locations of rotation thereof.

In a similar manner the second piston assembly means 58 will include a second piston rod means 60 extending longitudinally through the second piston bore means 36. Second piston rod means 60 defines a third rod end means 64 and a fourth rod end means 66 at opposite ends thereof. A third piston means 68 is operatively attached with respect to the third rod end means 64 and the fourth piston means 70 is operatively attached with respect to the fourth rod end means 66. The second piston rod means 60 defines a second connecting bore means 62 centrally located therein adapted to receive the offset second connecting arm means 42 extending therethrough. As power is applied to the third and fourth piston means 68 and 70 reciprocating movement of the second piston rod means 50 will be achieved along with reciprocating movement of the second connecting arm means 42 within the slotted second connecting arm aperture means 16. This will provide power to the crankshaft means 18 at selected rotary positions thereof.

Control of power to the first, second, third and fourth piston means 54, 56, 68 and 70 is achieved by conventional head means 84 positioned at opposite ends of the first piston bore means 34 and second piston bore means 36 as shown best in FIG. 1.

Figure 3:
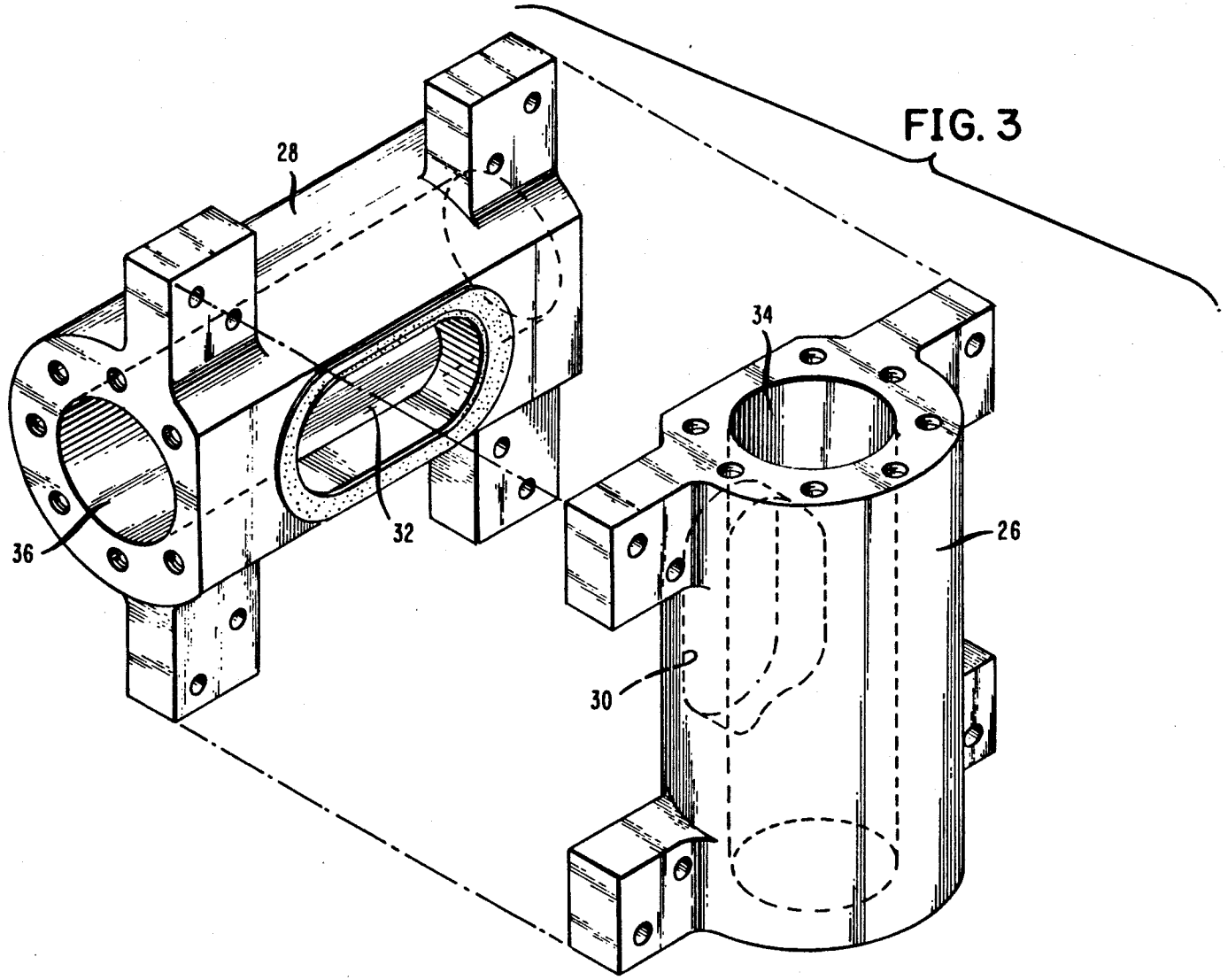
FIG. 3 is a perspective illustration of an alternative embodiment of the internal combustion engine of the present invention showing embodiments of the outer crankcase members.
Figure 4:
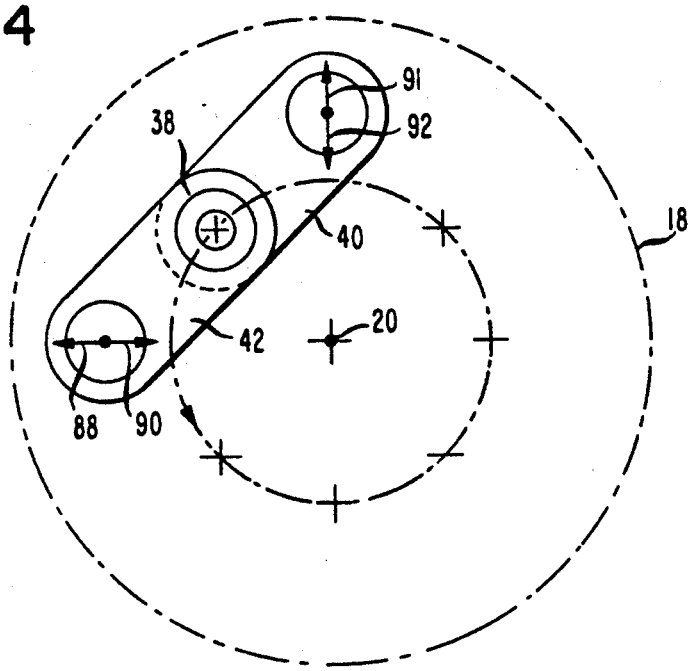
FIG. 4 is a schematic view of an embodiment of the power schematic of the present invention.

As shown in FIG. 4 the crankshaft 18 is capable of rotation about the axis 20 defined thereon. The crank pin means 38 is adapted to urge rotation of the crankshaft 18 responsive to powering of the cylinder. Powering of the first piston means 54 will cause a vector force in the direction indicated by arrow 88. Powering of the second piston means 56 will urge a movement along the direction of arrow 90 as shown in FIG. 4. In a similar manner powering of the third piston means 68 will cause a force to be exerted upon the crank pin means 38 in direction 92 and powering of the fourth piston 70 will cause a vector force to be directed upon the crank pin 38 in the direction 94. The various powering normally by combustion of each of the pistons can be controlled by a conventional ignition timing device which will control the powering of the pistons to the advanced or retarded degree of dwell as may be required for a particular application and for efficient operation of the invention. These configurations are conventionally available. The present invention primarily deals with the mechanical configuration of the reciprocating parts in order to achieve a full and complete efficient operation over a wide range of load conditions. The first and second outer crankcases 26 and 28 can comprise the configuration shown in FIG. 1 or alternatively can comprise the configuration shown in FIG. 3. The FIG. 3 configuration is somewhat more useful with smaller overall engine designs but clearly either configuration is equally operable.

As described in the embodiment above, two pairs of piston sets are preferably included in the configuration of the present invention. Alternatively only one set of pistons could be included connected with respect to one another by a single piston rod means. This configuration will work equally well to the four piston configuration shown in the figures. This configuration will basically include the showing of the figures of this invention having, however, only one outer crankcase rather than two outer crankcases.

Figure 6:
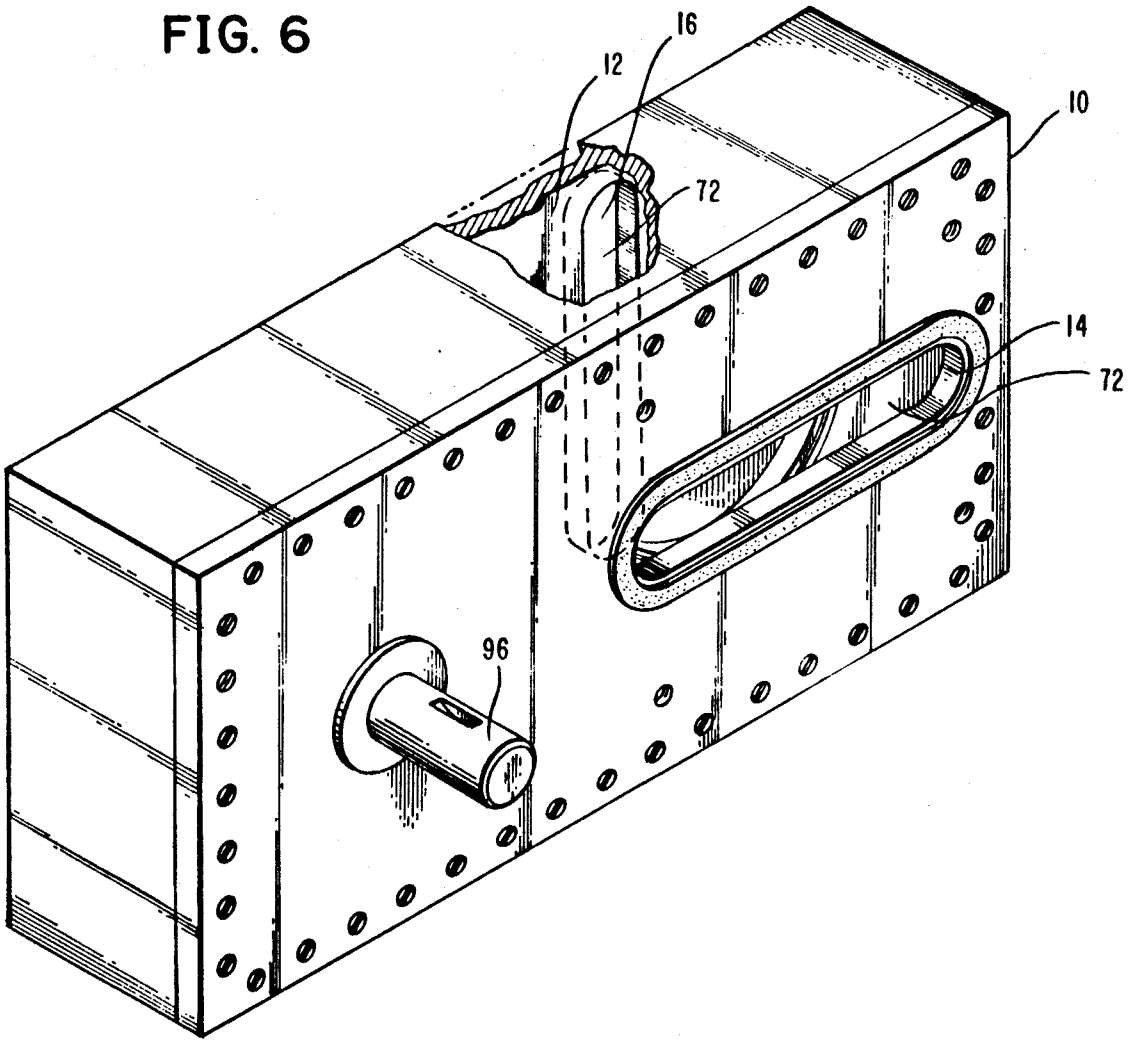
FIG. 6 is perspective illustration of an alternative embodiment of the inner crankcase element of the present invention.

FIG. 6 shows an alternative configuration for the crankcase wherein the counter shaft 96 extends outwardly from the inner crankcase means 10 in such a manner as to facilitate the extraction of power from the motor during operation thereof.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. An internal combustion apparatus having opposed sets of pistons comprising:

a) an inner crankcase means defining an inner chamber means therein, said inner crankcase means further defining a first connecting arm aperture means and a second connecting arm aperture means therein;

b) a crankshaft means rotatably mounted within said inner chamber means of said inner crankcase means and defining a crankshaft axis means extending axially therethrough, said crankshaft means being generally disk-shaped and defining a crank pin aperture means extending axially therethrough spatially disposed radially with respect to said crankshaft axis means to be rotatable around said crankshaft axis means responsive to rotation of said crankshaft means, said crankshaft means defining a driving means peripherally therearound to facilitate distribution of driving power therefrom;

c) a first outer crankcase means defining a first outer chamber means in fluid flow communication with respect to said inner chamber means through said first connecting arm aperture means, said first outer crankcase means defining a first piston bore means extending longitudinally therein;

d) a second outer crankcase means defining a second outer chamber means in fluid flow communication with respect to said inner chamber means through said second connecting arm aperture means, said second outer crankcase means defining a second piston bore means extending longitudinally therein;

e) a crank pin means positioned extending through said crank pin aperture in said crankshaft means, said crank pin means being rotatable with respect to said crank pin aperture means;

f) a first connecting arm means fixedly secured with respect to one end of said crank pin means and extending through said first connecting arm aperture means into said first outer crankcase means, said first connecting arm means including a first offset arm to facilitate orientation thereof in a position radially offset with respect to said crank pin aperture;

g) a second connecting arm means fixedly secured with respect to the other end of said crank pin means and extending through said second connecting arm aperture means into said second outer crankcase means, said second connecting arm means including a second offset arm to facilitate orientation thereof in a position radially offset with respect to said crank pin aperture in a direction axially opposite from said first offset arm;

h) a first piston assembly means positioned extending through said first piston bore means to be reciprocally axially movable therein comprising:

(1) a first piston rod means extending longitudinally through said first piston bore means and defining a first connecting bore means therein, said first offset arm of said first connecting arm means adapted to extend through said first connecting arm aperture means into said first connecting bore means to urge movement of said first piston rod means therewith, said first piston rod means defining a first rod end means and a second rod end means;

(2) a first piston means attached to said first rod end means;

(3) a second piston means attached to said second rod end means;

i) a second piston assembly means positioned extending through said second piston bore means to be reciprocally axially movable therein comprising:

(1) a second piston rod means extending longitudinally through said second piston bore means and defining a second connecting bore means therein, said second offset arm of said second connecting arm means adapted to extend through said second connecting arm aperture means into said second connecting bore means to urge movement of said second piston rod means therewith, said second piston rod means defining a third rod end means and a fourth rod end means;

(2) a third piston means attached to said third rod end means; and (3) a fourth piston means attached to said fourth rod end means.

2. An internal combustion apparatus having opposed sets of pistons as defined in claim 1 wherein said first piston means and said second piston means are fixedly secured with respect to said first piston rod means.

3. An internal combustion apparatus having opposed sets of pistons as defined in claim 1 wherein said third piston means and said fourth piston means are fixedly secured with respect to said second piston rod means.

4. An internal combustion apparatus having opposed sets of pistons as defined in claim 1 wherein said first connecting arm aperture means and said second connecting arm aperture means each comprise slot means oriented perpendicularly with respect to one another.

5. An internal combustion apparatus having opposed sets of pistons as defined in claim 1 wherein said driving means on said crankshaft means comprises a gear drive means.

6. An internal combustion apparatus having opposed sets of pistons as defined in claim 1 wherein said driving means on said crankshaft means comprises a friction surface drive means.

7. An internal combustion apparatus having opposed sets of pistons as defined in claim 1 wherein said first piston bore means and said second piston bore means are oriented perpendicularly with respect to one another.

8. An internal combustion apparatus having opposed sets of pistons as defined in claim 1 wherein said first piston rod means and said second piston rod means are oriented perpendicularly with respect to one another.

9. An internal combustion apparatus having opposed sets of pistons as defined in claim 1 further comprising a crank pin aperture bearing means positioned within said crank pin aperture means and adapted to receive said crank pin means extending therethrough to facilitate rotational movement of said crank pin means with respect to said crankshaft means.

10. An internal combustion apparatus having opposed sets of pistons as defined in claim 1 further comprising head means positioned on the outside opposite ends of said first piston bore means and on the outside opposite ends of said second piston bore means.

11. An internal combustion apparatus having opposed sets of pistons as defined in claim 1 wherein said first piston assembly is reciprocally movable in a plane perpendicularly oriented with respect to the axis of rotation of said crankshaft means.

12. An internal combustion apparatus having opposed sets of pistons as defined in claim 1 wherein said second piston assembly is reciprocally movable in a plane perpendicularly oriented with respect to the axis of rotation of said crankshaft means.

13. An internal combustion apparatus having opposed sets of pistons as defined in claim 1 further including a crankshaft bearing means mounted within said inner crankcase means and adapted to receive said crankshaft means mounted therein to facilitate rotational movement thereof with respect to said inner crankcase means.

14. An internal combustion apparatus having opposed sets of pistons as defined in claim 1 wherein said first outer crankcase means is fixedly secured with respect to said inner crankcase means.

15. An internal combustion apparatus having opposed sets of pistons as defined in claim 1 wherein said second outer crankcase means is fixedly secured with respect to said inner crankcase means.

16. An internal combustion apparatus having opposed set of pistons comprising:

a) an inner crankcase means defining an inner chamber means therein, said inner crankcase means further defining a first connecting arm aperture means therein comprising a first slot means and a second connecting arm aperture means therein comprising a second slot means oriented perpendicularly with respect to said first slot means;

b) a crankshaft means rotatably mounted within said inner chamber means of said inner crankcase means and defining a crankshaft axis means extending axially therethrough, said crankshaft means being generally disk-shaped and defining a crank pin aperture means extending axially therethrough spatially disposed radially with respect to said crankshaft axis means to be rotatable around said crankshaft axis means responsive to rotation of said crankshaft means, said crankshaft means defining a driving means peripherally therearound to facilitate distribution of driving power therefrom;

c) a first outer crankcase means fixedly secured with respect to said inner crankcase means, said first outer crankcase means defining a first outer chamber means in fluid flow communication with respect to said inner chamber means through said first connecting arm aperture means, said first outer crankcase means defining a first piston bore means extending longitudinally therein;

d) a second outer crankcase means fixedly secured with respect to said inner crankcase means, said second outer crankcase means defining a second outer chamber means in fluid flow communication with respect to said inner chamber means through said second connecting arm aperture means, said second outer crankcase means defining a second piton bore means extending longitudinally therein perpendicularly with respect to said first piston bore means;

e) a crankshaft bearing means mounted within said inner crankcase means and adapted to receive said crankshaft means mounted therein to facilitate rotational movement thereof with respect to said inner crankcase means;

f) a crank pin means positioned extending through said crank pin aperture in said crankshaft means, said crank pin means being rotatably movable with respect to said crank pin aperture means;

g) a crank pin aperture bearing means positioned within said crank pin aperture means and adapted to receive said crank pin means extending therethrough to facilitate rotational movement of said crank pin means with respect to said crankshaft means;

h) a first connecting arm means fixedly secured with respect to said crank pin means fixedly extending through said first connecting arm aperture means into said first outer crankcase means, said first connecting arm means including a first offset arm to facilitate orientation thereof in a position radially offset with respect to said crank pin aperture;

i) a second connecting arm means fixedly secured with respect to said crank pin means and extending through said second connecting arm aperture means into said second outer crankcase means, said second connecting arm means including a second offset arm to facilitate orientation thereof in a position radially offset with respect to said crank pin aperture in a direction axially opposite from said first offset arm;

j) a first piston assembly means positioned extending through said first piston bore means to be reciprocally axially movable therein, said first piston assembly being movable in a plane perpendicularly oriented with respect to said crankshaft axis means, said first piston assembly comprising:

(1) a first piston rod means extending longitudinally through said first piston bore means and defining a first connecting bore means therein, said first connecting arm means adapted to extend through said first connecting arm aperture means into said first connecting bore means to urge movement of said first piston rod means therewith, said first offset arm adapted to position said first connecting bore means radially offset axially with respect to said crank pin aperture means, said first piston rod means defining a first rod end means and a second rod end means;

(2) a first piston means fixedly secured to said first rod end means;

(3) a second piston means fixedly secured to said second rod end means;

k) a second piston assembly means positioned extending through said second piston bore means to be reciprocally axially movable therein, said second piston assembly being movable in a plane perpendicularly oriented with respect to said crankshaft axis means and perpendicularly oriented with respect to said first piston assembly means, said second piston assembly comprising:

(1) a second piston rod means extending longitudinally through said second piston bore means perpendicularly with respect to said first piston rod means and defining a second connecting bore means therein, said second connecting arm means adapted to extend through said second connecting arm aperture means into said second connecting bore means to urge movement of said second piston rod means therewith, said second offset arm adapted to position said second connecting bore means radially offset axially with respect to said crank pin aperture means, said second piston rod means defining a third rod mend means and a fourth rod end means;

(2) a third piston means fixedly secured to said third rod end means; and (3) a fourth piston means fixedly secured to said fourth rod end mean.

* * * * *

UNITED STATES PATENT AND TRADEMARK OFFICE

CERTIFICATE OF CORRECTION

PATENT NO. : 5,228,416
DATED : July 20, 1993
INVENTOR(S) : Eugene T. Puzio

It is certified that error appears in the above-identified patent and that said Letters Patent is hereby corrected as shown below:

In column 9, line 48, change "piton" to -- piston --.

Signed and Sealed this

First Day of March, 1994

Bruce Lehman

*Attest:*

BRUCE LEHMAN

*Attesting Officer*

*Commissioner of Patents and Trademarks*